US008093191B2

(12) United States Patent
Fahmy et al.

(10) Patent No.: US 8,093,191 B2
(45) Date of Patent: Jan. 10, 2012

(54) ENGINE LUBRICANT FOR IMPROVED FUEL ECONOMY

(75) Inventors: Mohamed G. Fahmy, Eastlake, OH (US); Daniel C. Visger, Mentor, OH (US); Barton J. Schober, Perry, OH (US); Brent R. Dohner, Concord, OH (US); Patrick E. Moster, Bay Village, OH (US); Jody A. Kocsis, Chagrin Falls, OH (US); Isao Nakagawa, Kanagawa-ken (JP)

(73) Assignee: The Lubrizol Corporation, Wickliffe, OH (US)

( * ) Notice: Subject to any disclaimer, the term of this patent is extended or adjusted under 35 U.S.C. 154(b) by 427 days.

(21) Appl. No.: 12/096,912

(22) PCT Filed: Dec. 14, 2006

(86) PCT No.: PCT/US2006/062076

§ 371 (c)(1), (2), (4) Date: Sep. 17, 2008

(87) PCT Pub. No.: WO2007/070845

PCT Pub. Date: Jun. 21, 2007

(65) Prior Publication Data

US 2009/0156438 A1 Jun. 18, 2009

Related U.S. Application Data

(60) Provisional application No. 60/750,628, filed on Dec. 15, 2005.

(51) Int. Cl.

| | |
|---|---|
| ***C10M 145/14*** | (2006.01) |
| ***C10L 1/22*** | (2006.01) |
| ***C10M 145/04*** | (2006.01) |

(52) U.S. Cl. ..... 508/470; 508/469; 508/471

(58) Field of Classification Search ..... 508/469, 508/470, 471

See application file for complete search history.

(56) References Cited

U.S. PATENT DOCUMENTS

| | | | | |
|---|---|---|---|---|
| 6,124,249 | A | 9/2000 | Seebauer et al. | 508/469 |
| 6,271,184 | B1 * | 8/2001 | Seebauer et al. | 508/469 |
| 6,586,375 | B1 * | 7/2003 | Gahagan et al. | 508/244 |
| 6,642,191 | B2 * | 11/2003 | Palazzotto et al. | 508/501 |
| 6,730,638 | B2 * | 5/2004 | Farng et al. | 508/194 |
| 2003/0162673 | A1 | 8/2003 | Kurihara et al. | 508/364 |

FOREIGN PATENT DOCUMENTS

| | | |
|---|---|---|
| EP | 0750031 | 8/2001 |

OTHER PUBLICATIONS

Search Report from corresponding PCT Publication WO 2007/A3; date of mailing of Search Report: Aug. 13, 2007.

Writen Opinion from corresponding PCT Application No. PCT/US2006/062076 completed Aug. 2, 2007.

* cited by examiner

*Primary Examiner* — Walter D Griffin

*Assistant Examiner* — Francis C Campanell

(74) *Attorney, Agent, or Firm* — David M. Shold; Michael F. Esposito

(57) ABSTRACT

A lubricant composition comprising an oil of lubricating viscosity, an amino-functionalized acrylic or methacrylic-containing polymer, comprising about 2 percent to about 8 percent by weight of an amine moiety bearing a tertiary amino group, attached to said polymer through an ester, amide, or imide linkage; and a nitrogen-containing dispersant, provides reduced friction to an internal combustion engine and improved fuel economy.

20 Claims, No Drawings

ENGINE LUBRICANT FOR IMPROVED FUEL ECONOMY

BACKGROUND OF THE INVENTION

The present invention relates to engine lubricants and the use of certain functionalized polymers for improved fuel economy in crankcase lubricants for internal combustion engines and other lubricating applications for transportation vehicles.

There are continuing efforts for improving fuel economy of internal combustion engines and in the vehicles which they propel. One way by which fuel economy can be improved is by reducing the internal friction within the engine itself. This may be accomplished by appropriate choice of lubricants to reduce friction and thus promote ease of movement of various engine parts, in addition to the numerous other benefits and properties provided by the lubricant. One way in which friction can be reduced is by employing base oils of relatively lower viscosity, and indeed there has been a trend in recent years to use of lower viscosity oils. However, one cannot simply reduce the viscosity of the lubricant without risking diminution of other benefits provided by the lubricant, such as protection against wear. Thus, for low viscosity oils, the formulation of the lubricant, and in particular the selection of additives incorporated within the base oil, is very important. A selection of additive or additives to reduce internal friction within an engine, regardless of the viscosity of the base oil, leading to improved fuel economy, will be highly desirable.

Numerous patents have appeared relating to additives for engine oils, seeking to provide various benefits. As an example, U.S. Pat. No. 6,124,249, Seebauer et al., Sep. 26, 2000, discloses viscosity improvers for lubricating oil compositions. It discloses a copolymer comprising units derived from (a) methacrylic acid esters containing from about 9 to about 25 carbon atoms in the ester group and (b) methacrylic acid esters containing from 7 to about 12 carbon atoms in the ester group, and optionally (c) at least one monomer which may be, among others, nitrogen-containing vinyl monomers. Examples are given of polymers prepared from 272.8 parts C12-15 methacrylate, 120 parts 2-ethylhexyl methacrylate, and 7.2 parts dimethylaminopropylmethacrylamide. These materials are described as viscosity improvers or viscosity index improvers, and they may also enhance dispersant properties of lubricants.

U.S. Patent Application 2004/0254080, Sivik et al., Dec. 16, 2004, discloses polymer compositions with $\alpha,\beta$-unsaturated ester monomers and at least one unsaturated dicarboxylic acid anhydride or derivatives thereof, and optionally at least one non-monomeric amine with primary functionality, secondary functionality, or mixtures thereof.

The present invention solves the problem of providing a lubricant which imparts reduced frictional losses to an engine or other mechanical device by incorporating therein a selected polymer, along with one or more additional additives. The lubricant of the present invention may be used to lubricate engines operating on a variety of fuels, including gasoline, diesel, alcohols, mixtures thereof, and hydrogen.

SUMMARY OF THE INVENTION

The present invention thus provides A composition suitable for lubricating an internal combustion engine, comprising: (a) an oil of lubricating viscosity; (b) an amino-functionalized acrylic or methacrylic-containing polymer, comprising 2 percent to 8 percent by weight of an amine moiety bearing a tertiary amino group, attached to said polymer through an ester, amide, or imide linkage, or a mixture of such linkages; and (c) a dispersant.

The invention further provides a method of lubricating an internal combustion engine, comprising supplying said engine with the composition described above.

DETAILED DESCRIPTION OF THE INVENTION

Various preferred features and embodiments will be described below by way of non-limiting illustration.

A first component in the composition of the present invention is an oil of lubricating viscosity Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil break-down products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch (i.e., gas-to-liquid) reactions and typically may be hydroisomerised Fischer-Tropsch hydrocarbons or waxes.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content <0.03 wt %, and >90 wt % saturates, viscosity index 80-120); Group III (sulfur content <0.03 wt %, and >90 wt % saturates, viscosity index >120); Group IV (all polyalphaolefins (PAOs)); and Group V (all others not included in Groups I, II, III, or IV). The oil of lubricating viscosity comprises an API Group I, Group II, Group III, Group IV, Group V oil and mixtures thereof. Often the oil of lubricating viscosity is an API Group I, Group II, Group III, Group IV oil and mixtures thereof. Alternatively the oil of lubricating viscosity is often an API Group I, Group II, Group III oil or mixtures thereof, or, in certain embodiments, a Group III oil.

The lubricating oil in the invention will normally comprise the major amount of the composition. Thus it will normally be at least 50% by weight of the composition, such as 83 to 98%, or 88 to 90%. As an alternative embodiment, however, the present invention can provide an additive concentrate in which the oil can be 1 to 50% or to 20% by weight, or 2 to 10%, and the other components, described in greater detail below, are proportionately increased.

The oil of lubricating viscosity will generally be selected so as to provide, among other properties, an appropriate viscosity and viscosity index. Most modern engine lubricants are multigrade lubricant which contain viscosity index improvers to provide suitable viscosity at both low and high temperatures. While the viscosity modifier is sometimes considered a part of the base oil, it is more properly considered as a separate component, the selection of which is within the abilities of the person skilled in the art.

Viscosity modifiers generally are polymeric materials characterized as being, in certain embodiments, hydrocarbon-based polymers, generally having number average molecular weights between 25,000 and 500,000, e.g., between 50,000 and 200,000.

Hydrocarbon polymers can be used as viscosity index improvers. Examples include homopolymers and copolymers of two or more monomers of C2 to C30, e.g., C2 to C8 olefins, including both alphaolefins and internal olefins, which may be straight or branched, aliphatic, aromatic, alkylaromatic, or cycloaliphatic. Examples include ethylene-propylene copolymers, generally referred to as OCP's, prepared by copolymerizing ethylene and propylene by known processes.

The polymers may also contain one or more vinyl aromatic monomers, and hydrogenated styrene-conjugated diene copolymers are an example of such a class of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene. Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of C4-18 alcohols also are useful as viscosity modifying additives in motor oils. Likewise, polymethacrylates (PMA) are used as viscosity modifiers. These materials are typically prepared from mixtures of methacrylate monomers having different alkyl groups, which may be either straight chain or branched chain groups containing 1 to 18 carbon atoms.

When a small amount of a nitrogen-containing monomer is copolymerized with alkyl methacrylates, dispersancy properties are incorporated into the product. Thus, such a product has the multiple function of viscosity modification, pour point depressancy and dispersancy and are sometimes referred to as dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. Dispersant viscosity modifiers may also be interpolymers of ethylene and propylene which are grafted with an active monomer such as maleic anhydride and then derivatized with an alcohol or an amine or grafted with nitrogen compounds.

The base oil and viscosity modifier may be selected to provide the desired viscosity grade, as will be apparent to those skilled in the art. Suitable viscosity grades include certain modern low-viscosity multigrades such as 0W-10, 0W-15, 0W-20, 0W-25, 0W-30, 5W-10, 5W-15, 5W-20, 5W-25, and 5W-30, which together may be written as xW-y, where x is 0 to 5 and y is 10 to 30, e.g., 10, 15, 20, 25, or 30. Alternatively, for higher viscosity grades, x may be 10, 15, or 20 provided y is greater than x. Traditionally x and y are selected from integral multiples of 5, although this is not a requirement. Common values for y are 20, 25, or 30, especially 20 or 30.

The composition of the present invention further comprises an amino-functionalized acrylic or methacrylic-containing polymer, comprising 2 percent to 8 percent by weight of an amine moiety bearing a tertiary amino group, attached to said polymer through an ester, amide, or imide linkage or a mixture of such linkages. (By "a mixture of such linkages" is meant that within an overall composition, a mixture of individual molecules may be present, and some such molecules may contain an ester linkage, some may contain an amide linkage, and some may contain an imide linkage, or any combinations or sub-combinations thereof). Such types of polymers in general are known, an example of such, and a method of its preparation being provided (with the exception noted) in example 11 of U.S. Pat. No. 6,124,249. This document discloses the copolymerization of 272.8 parts C12-15 methacrylate, 120 parts 2-ethylhexyl methacrylate, and 7.2 parts dimethylaminopropylmethacrylamide. It will be recognized that the dimethylaminopropylmethacrylamide comprises the condensation product of methacrylic acid with an amine moiety bearing a tertiary amino group, namely, dimethylaminopropylamine. It is indeed often convenient to introduce the amine functionality into the polymer by precondensing the corresponding amine (or an alcohol) onto an appropriate monomer, to form the corresponding amide (if the monomer corresponds to an acid) or imide (if the monomer corresponds to a diacid or anhydride, such as maleic anhydride) or ester (if the amine-bearing moiety contains a hydroxy functional group).

It is noted, however, that the polymer of the present invention is distinguished from that of U.S. Pat. No. 6,124,249 in that the amount of the amine functionality in the polymers of the present invention is in general greater than that of said patent. In particular, the polymer prepared by Example 11 of U.S. Pat. No. 6,124,249 employs about 1.8 weight percent of the dimethylaminopropyl-methacrylamide monomer. This monomer comprises about 65% by weight amine component and 35% by weight acid residue (after loss of water of condensation), and thus the polymer as a whole in the example of the reference patent contains only about 1.2 percent of the amine moiety. In contrast, the amount of amine moiety within the polymers employed in the present invention is 2 to 8 percent by weight, or alternatively 2.5 to 6 percent or 2.5 to 5 percent by weight. The amount of the "amine moiety" for the purpose of the weight calculation is the weight if the incorporated diamine or polyamine or hydroxylamine minus one hydrogen. The amount of the amine functionality may also be expressed as the weight percent of the tertiary nitrogen atoms, provide by the amine moiety, contained within the polymer. In dimethylaminopropylamine, for instance, the tertiary nitrogen atom comprises about 13.7% of the amine moiety. Thus, suitable amounts of tertiary nitrogen derived therefrom in the polymer may be 0.27% to 1.1% by weight or 0.34% to 0.82% or to 0.68%, or 0.3 to 0.9% N.

The amine moiety will be an amine moiety bearing at least one tertiary amino group and at least one amino group or hydroxy group through which the amine moiety can be linked to the polymer, through an ester, amide, or imide linkage. Suitable amines include polyamines such as dimethylaminopropylamine (that is, N,N-dimethylaminopropylamine), N,N-dimethylaminoethylamine, and N-(aminopropyl)morpholine, as well as hydroxyamines such as N,N-dimethylethanolamine. These amines may be generally represented by the formula $$(HR^1{}_nX)_a—R^2—(NR^3R^4)_b$$

where $R^2$ is a hydrocarbyl radical of valence a+b, typically containing 1 to 8 carbon atoms, e.g., an ethylene, propylene, or butylene group; a is at least 1 and is typically 1; b is at least 1, such as 1 or 2, and is typically 1; and X is O or N. When X is O, then n is 0, and when X is N, then n is 1. $R^1$ is hydrogen or alternatively a hydrocarbyl group, such as a short alkyl group such as methyl or ethyl. $R^3$ and $R^4$ are each independently hydrocarbyl groups such as lower alkyl groups of 1 to 8 carbon atoms, such as methyl, ethyl, or propyl groups. In certain embodiments R3 and R4 are each methyl groups. In certain embodiments $R^1$ is H, $R^2$ is ethylene or propylene, and $R^3$ and $R^4$ are each methyl.

The remainder of the polymer, that is, the polymer onto which the amine moiety is affixed, is an acrylic or methacrylic-containing polymer which may have a weight average molecular weight of 1,000 to 1,000,000, alternatively 10,000 to 500,000 or 50,000 to 250,000. (The term "(meth)acrylic" is used herein to designate to acrylic or methacrylic.) Suitable (meth)acrylic polymer backbones are known in the art and are described in greater detail in, for instance, the aforementioned U.S. Pat. No. 6,124,249. This document discloses a copolymer comprising units derived from (a) methacrylic acid esters containing from about 9 to about 25 carbon atoms in the ester group and (b) methacrylic acid esters containing from 7 to about 12 carbon atoms in the ester group, said ester groups having 2-(C1-4alkyl)-substituents, with a proviso that no more than 60% by weight of the esters contain not more than 11 carbon atoms in the ester group (that is, up to 60% of the esters contain 11 or fewer carbon atoms). The number of carbon atoms in the ester group —C(O)OR is defined in the aforementioned patent as the total of the carbon atom of the carbonyl group and the carbon atoms of the OR group. Thus, for example, methyl methacrylate contains two carbon atoms in the ester group. Suitably, ester (a) can be a C12-25 alkyl methacrylate and ester (b) can be 2-ethylhexyl methacrylate. The mole ratio of esters (a) to esters (b) may be 95:5 to 35:65, or 90:10 to 60:50, or 80:20 to 50:50. Further specific details of the composition of such polymers, with regard to esters (a) and (b) are found in columns 4 and 5 of U.S. Pat. No. 6,124,249. In the present invention, suitable (meth)acrylate esters may be also prepared from alcohols of a variety of carbon chain lengths, including methanol, ethanol, propanol, butanol, octanol, decanol, dodecanol, C12-14 alcohols, C12-15 alcohols, C16-18 alcohols, and C16-20 alcohols and mixtures thereof. Both straight chain and branched alcohols are contemplated. In certain embodiments, the alcohols can be a mixture of 2-ethylhexanol and lauryl alcohol (i.e., dodecyl alcohol). The ester groups should overall have sufficient length, or average carbon number, that the polymer itself will be oil-soluble. Thus, for example, a polymer having on average 11.8 carbon atoms in the ester groups (i.e., from on alcohols with on average 10.8 carbon atoms) may be suitable as well as, more generally, polymers having an average of at least 9 or at least 10 or at least 11 carbon atoms in the ester groups. and up to an average of 31 or 25 or 21 or 19 carbon atoms in the ester groups.

If the amine moiety of the present invention is incorporated into the polymer by means of copolymerization of an acid-amine condensate, such comonomer may be designated as comonomer (c) and copolymerized with esters (a) and (b) as described in the aforementioned patent.

As described above, the amine may be incorporated onto the polymer by copolymerization of monomers which already contain the amine moiety, or by reaction of the amine onto the pre-formed polymer backbone, for instance, by condensation of an alcohol group of an aminoalcohol to form an ester linkage, or by condensation of a primary or secondary amino group of a di- or polyamine to form an amide or imide linkage. The group on the polymer which forms the link to the amine will comprise a carbonyl group, which is typically in the form of a carboxylic acid or reactive equivalent thereof, such as an anhydride. Examples include acrylic acid, methacrylic acid or their esters, halides, or anhydrides, and maleic acid, esters, and anhydride. Any of the foregoing materials may be copolymerized into the chain of the polymer or they may be grafted onto the chain by, e.g., free radial reactions, particularly if the polymer chain contains olefin monomers or polyolefin segments which are particularly subject to such grafting. Such methods for forming the polymers are within the abilities of the person skilled in the art.

It will be apparent that the amino-functionalized acrylic or methacrylic-containing polymer is itself or may itself be a dispersant viscosity modifier as been as described above. Thus the presently described polymer may comprise the sole viscosity modifier within the formulation, or alternatively, additional viscosity modifiers, which may also be dispersant viscosity modifiers, may be present in order to meet the requirements of the particular end use of the lubricant.

The amount of the amino-functionalized polymer may typically be 0.2 to 4 percent by weight of the composition, or alternatively 0.5 to 2 percent or 0.7 to 1 percent, or combinations of such upper and lower limits.

The composition of the present invention will also include a dispersant which, in certain embodiments, is a nitrogen-containing dispersant. This will be in addition to any dispersant properties contributed by the above described amino-functionalized acrylic or methacrylic-containing polymer. However, any dispersant-viscosity modifier as described above may be construed as the nitrogen-containing dispersant. In certain embodiments, however, the nitrogen-containing dispersant is other than a polymeric dispersant-viscosity modifier.

Dispersants, including nitrogen-containing dispersants, are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include N-substituted long chain alkenyl succinimides, having a variety of chemical structures including typically

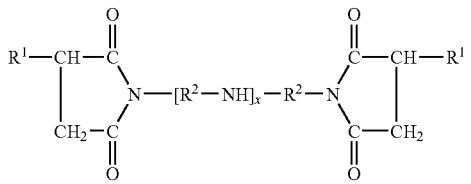

where each $R^1$ is independently an alkyl group, frequently a polyisobutenel group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892.

Another class of ashless dispersant is high molecular weight esters (which are not normally considered to be nitrogen-containing dispersants). These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of nitrogen-containing ashless dispersant is Mannich bases. These are materials which are formed by the condensation of a higher molecular weight, alkyl substituted phenol, an alkylene polyamine, and an aldehyde such as formaldehyde. Such materials may have the general structure

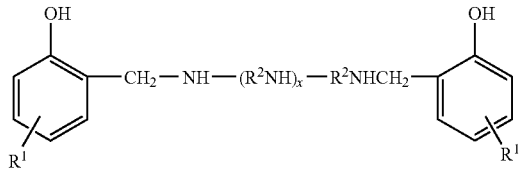

(including a variety of isomers and the like) and are described in more detail in U.S. Pat. No. 3,634,515.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the nitrogen-containing dispersant in the composition may typically be 0.4 to 5 percent by weight, or 0.4 to 2.6 percent, or 1 to 2.5 percent, or 1.5 to 2.4 percent, or 2 to 2.3 percent. Such amounts may be less than the amounts conventionally present in other lubricant compositions designed for the present uses.

Other additives may also be present, including those described in the following paragraphs. Metal-containing detergents are typically overbased materials, otherwise referred to as overbased or superbased salts. They are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol.

The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In certain embodiments of the present invention, an overbased calcium salicylate detergent may be present. These materials may be made by applying the overbasing process to a hydrocarbyl-substituted salicylic acid. In other embodiments, the alkylsalicylate may be an alkali metal salt or an alkaline earth metal salt of an alkylsalicylic acid which can in turn be prepared from an alkylphenol by Kolbe-Schmitt reaction. The alkylphenol may be prepared, in turn, by a reaction of α-olefin having, for instance, 8 to 30 carbon atoms (mean number) with phenol. Related materials, which may fall within the general scope of salicylate detergents, include overbased salixarate detergents. These include overbased materials prepared from salicylic acid (which may be unsubstituted) with a hydrocarbyl-substituted phenol, such entities being linked through —$CH_2$— or other alkylene bridges. It is believed that the salixarate derivatives have a predominantly linear, rather than macrocyclic, structure, although both structures are intended to be encompassed by the term "salixarate." Salixarate derivatives and methods of their preparation are described in greater detail in U.S. Pat. No. 6,200,936 and PCT Publication WO 01/56968.

The amount of the overbased detergent, if present, may be up to 3 percent by weight of the lubricant composition or 1 to 2.5 percent by weight, or 2 to 2.3 percent by weight. Such amounts may be less than the amounts conventionally present in other lubricant compositions designed for the present uses, e.g., typically about 1.9 or 2.7 percent by weight for conventional lubricants.

The lubricant may also contain an antioxidant. Antioxidants encompass phenolic antioxidants, which may be of the general the formula

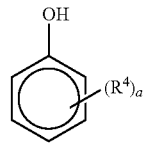

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups in the position ortho to the OH group. The para position may also be occupied by a hydrocarbyl group or a group bridging two aromatic rings. In certain embodiments the para position is occupied by an ester-containing group, such as, for example, an antioxidant of the formula

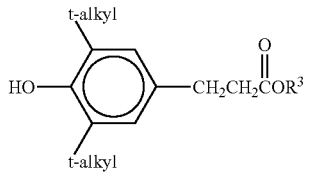

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines, such as those of the formula

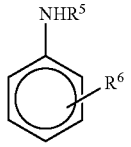

wherein $R^5$ can be a phenyl group or a phenyl group substituted by $R^7$, and $R^6$ and $R^7$ can be independently a hydrogen or an alkyl group containing 1 to 24 or 4 to 20 or 6 to 12 carbon atoms. In one embodiment, an aromatic amine anti-oxidant can comprise an alkylated diphenylamine such as nonylated diphenylamine or a mixture of a di-nonylated amine and a mono-nonylated amine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts; an example is sulfurized carbobutoxy cyclohexene. Details of methods of preparing some such sulfurized materials can be found in U.S. Pat. Nos. 3,471,404 and 4,191,659. In certain embodiments, a sulfurized olefin is present in an amount of 0.01 to 2 percent by weight, or 0.1 to 1 percent or 0.2 to 0.6 percent.

Molybdenum compounds can also serve as antioxidants, and these materials can also serve in various other functions, such as antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition. Such materials includes molybdenum dithiocarbamates, which are commercially available as Sakuralube™. In certain embodiments a molybdenum dithiocarbamate may be present in an amount of 0.01 to 2% or 0.1 to 1.3% or 0.3 to 0.9%. In certain embodiments the lubricant may contain 10 to 2000 ppm Mo or 100 to 2000 ppm Mo, or 500 to 1000 ppm Mo, or 600 to 900 ppm Mo, or 50 to 300 ppm Mo, which may be delivered by molybdenum dithiocarbamate.

Typical amounts of antioxidants will, of course, depend on the specific antioxidant and its individual effectiveness, but illustrative total amounts may be 0.01 to 5 percent by weight or 0.15 to 4.5 percent or 0.2 to 4 percent.

In one embodiment, the lubricant comprises an antioxidant other than a hindered phenolic antioxidant, and the hindered phenolic antioxidant may, in some embodiments, be absent.

The lubricant may also contain a metal salt of a phosphorus acid. Metal salts of the formula $$[(R^8O)(R^9O)P(=S)—S]_n\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates. Such materials are well known and readily available to those skilled in the art of lubricant formulation.

The amount of the metal salt of a phosphorus acid in a completely formulated lubricant, if present, may typically be up to 1 percent by weight, such as 0.1 to 0.8 percent by weight or 0.2 to 0.7, or 0.3 to 0.5 percent.

Zinc dialkyldithiophosphates contribute phosphorus to the lubricant composition, since they may contain approximately 10 percent by weight phosphorus. Since it may be desirable that the total phosphorus content of the lubricant is relatively low, such as up to 0.1 percent by weight, or 0.01 to 0.10% or 0.01% to 0.08% or 0.01 to 0.06% by weight, the amount of the zinc dialkyldithiophosphate and other sources of phosphorus may be correspondingly limited. In one embodiment the amount of phosphorus may be delivered by the zinc dialkyldithiophosphate and may be 0.01 to 0.10 percent by weight. In one embodiment the amount of the zinc dialkyldithiophosphate is sufficient to deliver up to 0.08 weight percent phosphorus to the composition, Yet other additives which may be conventional for use in lubricants, and well known to those skilled in the art, may be used. These include, but are not limited to, corrosion inhibitors, extreme pressure and anti-wear agents (including chlorinated aliphatic hydrocarbons and boron-containing compounds such as borate esters), pour point depressants, and anti-foam agents.

These and other additives are described in greater detail in U.S. Pat. No. 4,582,618 (column 14, line 52 through column 17, line 16, inclusive).

In one embodiment, the invention provides a method of lubricating an internal combustion engine, comprising supplying said engine with the composition described above. The composition may be supplied, for example, from the sump of a sump-lubricated engine, or by other means. This method of lubricating an internal combustion engine may also be seen as a method for reducing friction within such an engine and as a method for improving fuel economy of such an engine, since these are seen to be results that may frequently accompany such a method of lubricating.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a pre-dominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Part A. Maleic anhydride-containing PMA. A 3.8 L (1-gallon) glass jar is charged with 239.6 g of 2-ethylhexyl methacrylate, 544.8 g of lauryl methacrylate, 342 g of Total™ 85N oil, 0.4 g Trigonox-21™ initiator and 0.4 g of n-dodecyl mercaptan and is stirred for 30 min. A 3 L, 4-necked flask, fitted with an overhead stirrer, reflux condenser, thermometer, and sub-merged nitrogen gas inlet tube is charged with approximately ⅓ of the above mixture and heated to 35° C. at which temperature it is further charged with 28.76 g maleic anhydride dissolved in 80 g acetone. The mixture is heated with stirring to 110° C. at which time an exotherm ensues which carries the temperature to 116° C. When the exotherm has peaked the remaining ⅔ of the monomer mixture is added over 90 minutes as the temperature falls to 110° C. where it is held. After this addition, the reaction flask is fitted with a Dean Stark trap and the acetone and any other volatiles are collected. The reaction vessel is then charged was 0.6 g of Trigonox-21™ initiator and held at 110° C. for an additional hour, at which time the remaining 858 g of Total™ 85N oil is added. The reaction is then stripped at 130° C. and 2.7 kPa (20 mm Hg) for 1 hour before filtering through cloth pads with the aid of 50 g of Fax-5™ filter aid.

Part B. Imidation Reaction. A 2 L, 4-necked flask, fitted with an overhead stirrer, thermometer, reflux condenser and a submerged nitrogen gas inlet tube, is charged with 800 g of a maleic anhydride-containing polymethacrylate from Part A. The mixture is heated while stirring and under a stream of nitrogen to 80° C. at which temperature 11.93 g of dimethylaminopropylamine (DMAPA) is added dropwise over 45 minutes. After stirring at 80° C. for 1 hr, the mixture is heated to 110° C. and held at that temperature for 1 hr. The reaction mixture is further heated to 120° C. and held at that temperature for an additional 2 hr, at which time and temperature the reaction is stripped at 2.7 kPa (20 mm Hg). Finally, 20 g of Fax-5™ filter aid is added and the mixture is filtered through cloth pads to give the desired dispersant polymer. The polymer product mixture contains 40 percent by weight polymer and 60 percent by weight of diluent oil. The polymer itself contains about 1% nitrogen or about 3.6% reacted DMAPA residue or about 0.5% tertiary nitrogen.

Example 2 and Comparative Example 3

Lubricant formulation are prepared as indicated in the table below:

| Component - percent by weight | Example 2 | Comparative Ex. 3 |
|---|---|---|
| Polymer of Example 1 (incl. 60% oil) | 2.0 | — |
| Oleamide (a conventional friction modifier) | — | 0.15 |
| Succinimide dispersant (incl. 47% oil) | 4.1 | 5.1 |
| Methacrylate copolymer viscosity modifier (incl. 53% oil) | 1.8 | 3.0 |
| Calcium overbased salicylate detergent, TBN 178 (incl. oil) | 3.5 | 3.5 |
| Pour point depressant(s) (incl. 54% oil) | 0.2 | 0.2 |
| Aromatic amine antioxidant(s) | 1.0 | 1.0 |
| Zinc dialkyldithiophosphate(s) (incl. 8-9% oil) | 0.84 | 0.84 |
| Sakuralube 515 ™ commercial molybdenum dithiocarbamate formulation | 0.81 | 0.81 |
| Sulfurized olefin(s) (incl. 5% oil) | 0.44 | 0.44 |
| Commercial antifoam agent | 0.01 | 0.01 |
| Additional diluent oil | 1.6 | 1.6 |
| Synthetic oil, API Group III, VI > 120 | balance | balance |

The above lubricant formulations are tested in a motor-driven engine assembly friction tester under ultra low speed conditions at 80° C. and 100° C. This test measures the frictional torque of the engine lubricated with the test formulation. The results are typically presented as a graph showing frictional torque (Nm) as a function of speed varying from e.g., 150 r.p.m. (revolutions per minute) to 500 r.p.m. or 750 r.p.m. or higher.

Over the speed range of at least 250 or 350 to 750 r.p.m., the material of Example 2 exhibits reduced friction compared to that of Comparative Example 3. The results show that formulations of the present invention can provide reduced friction compared with a conventional lubricants containing even 0.15% (the maximum practical soluble amount) of a known friction modifier, oleamide. Moreover a reduced amount of both viscosity modifier and dispersant can be employed.

Comparative Example 4

A formulation similar to that of Example 2 is prepared, containing however a polymer prepared as in Example 1 but containing only about ½ the amounts of maleic anhydride monomer and DMAPA. Thus, it will contain only about 1.8% DMAPA. The friction performance in the above test is not as good as that of Example 2.

Example 5

A 3.8 L (1-gallon) glass jar is charged with 574.0 g of 2-ethylhexyl methacrylate, 1674.5 g of C12-15 alkyl methacrylate, 1602 g diluent oil, 1.62 g Trigonox-21™ initiator and 1.62 g of n-dodecyl mercaptan and is stirred for 30 min. A 12 L, 4-necked flask, fitted with an overhead stirrer, reflux condenser, thermometer, and submerged nitrogen gas inlet tube is charged with approximately ⅓ of the above mixture and heated to 35° C. at which temperature it is further charged with 143.5 g N,N-dimethylaminopropyl methacrylamide. The mixture is heated with stirring and a nitrogen flow of 17 L/hour (0.6 $ft^3$/hr) to 110° C. at which time an exotherm ensues which carries the temperature to 126° C. When the exotherm has peaked, the remaining ⅔ of the monomer mixture is added over 90 minutes at 110° C. After this addition, the stirring is continued for 1 hour at 110° C. with nitrogen flow of 14 L/hour (0.5 $ft^3$/hr). An additional charge of 1.2 g Trigonox-21™ initiator is added and stirring is continued for 1 hour at 110° C. The addition of trigonox-21™ and stirring is repeated three more times, for a total of 4 incremental additions of 1.2 g each. The contents are heated to 130° C. with stirring and 28 L/hour (1 $ft^3$/hr) nitrogen flow for an hour, and the mixture is then vacuum stripped at 130° C. and 2.7 kPa pressure (20 mm Hg). An additional 1990 g diluent oil is added and the resulting mixture is filtered at 100° C. through cloth pads with the aid of 50 g of Fax-5™ filter aid to give the desired dispersant polymer. Optionally, an additional 1331 diluent oil may be further added.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition suitable for lubricating an internal combustion engine, comprising:

(a) an oil of lubricating viscosity (b) an amino-functionalized acrylic or methacrylic-containing polymer, comprising about 2 percent to about 8 percent by weight of an amine moiety bearing a tertiary amino group, attached to said polymer through an ester, amide, or imide linkage or a mixture of such linkages; and (c) a dispersant.

2. The composition of claim 1 wherein the amine moiety is condensed onto the polymer through an acrylic, methacrylic, or succinic group.

3. The composition of claim 2 wherein the amine moiety comprises a hydroxylamine or a diamine, in either case containing one tertiary amino group, the condensation being through an ester group or through an amide or imide group, respectively.

4. The composition of claim 3 wherein the amine moiety comprises N,N-dimethylaminopropylamine, N,N-dimethylaminoethylamine, or N-(aminopropyl)morpholine.

5. The composition of claim 3 wherein the amine moiety comprises about 3.5 percent to about 5 percent by weight of the polymer.

6. The composition of claim 1 wherein the nitrogen atoms in the tertiary amino groups comprise about 0.3 to about 0.9 percent by weight of the amino-functionalized polymer.

7. The composition of claim 1 wherein the amino-functionalized polymer comprises about 0.2 to about 4 percent by weight of the composition.

8. The composition of claim 1 wherein the amino-functionalized polymer has a weight average molecular weight of about 1,000 to about 1,000,000.

9. The composition of claim 1 wherein the dispersant is a succinimide dispersant containing a polyisobutene group, said dispersant being present in an amount of 0.4 to 5 percent by weight.

10. The composition of claim 1 wherein the composition contains 10 to 2000 parts per million by weight molybdenum.

11. The composition of claim 1 wherein the composition contains 0.01 to 0.10 percent by weight phosphorus.

12. The composition of claim 1 wherein the oil of lubricating viscosity comprises an API Group III oil.

13. The composition of claim 1 wherein the composition has a viscosity grade of xW-y, where x is 0 or 5 and y is 20, 25, or 30.

14. The composition of claim 1 further comprising an antioxidant other than a hindered phenolic antioxidant.

15. The composition of claim 1 further comprising a zinc dialkyldithiophosphate in an amount suitable to deliver up to 0.08 weight percent phosphorus.

16. The composition of claim 1 further comprising up to about 3 percent by weight of an overbased detergent.

17. The composition of claim 16 wherein the overbased detergent is an overbased calcium salicylate detergent.

18. The composition of claim 1 further comprising about 0.01 to about 2 percent by weight of a sulfurized olefin.

19. A composition prepared by admixing the components of claim 1.

20. A method of lubricating an internal combustion engine, comprising supplying said engine with the composition of claim 1.

* * * * *

UNITED STATES PATENT AND TRADEMARK OFFICE

CERTIFICATE OF CORRECTION

PATENT NO. : 8,093,191 B2
APPLICATION NO. : 12/096912
DATED : January 10, 2012
INVENTOR(S) : Mohamed G. Fahmy et al.

It is certified that error appears in the above-identified patent and that said Letters Patent is hereby corrected as shown below:

On the title page, item (75), Inventors, is corrected to read as follows:

(75) Inventors: Mohamed G. Fahmy, Eastlake, OH (US);
Daniel C. Visger, Mentor, OH (US);
Barton J. Schober, Perry, OH (US);
Brent R. Dohner, Concord, OH (US);
Patrick E. Mosier, Bay Village, OH (US);
Jody A. Kocsis, Chagrin Falls, OH (US);
Isao Nakagawa, Kanagawa-ken (JP)

Signed and Sealed this
Twenty-eighth Day of August, 2012

David J. Kappos

David J. Kappos
*Director of the United States Patent and Trademark Office*